US009900940B2

(12) United States Patent
Wu et al.

(10) Patent No.: US 9,900,940 B2
(45) Date of Patent: Feb. 20, 2018

(54) LIGHT-EMITTING DIODE DEVICE

(71) Applicant: Lextar Electronics Corporation, Hsinchu (TW)

(72) Inventors: En-Min Wu, Taipei (TW); Hsien-Chih Ho, Zhubei (TW)

(73) Assignee: LEXTAR ELECTRONICS CORPORATION, Hsinchu (TW)

( * ) Notice: Subject to any disclaimer, the term of this patent is extended or adjusted under 35 U.S.C. 154(b) by 185 days.

(21) Appl. No.: 15/008,490

(22) Filed: Jan. 28, 2016

(65) Prior Publication Data

US 2017/0071037 A1 Mar. 9, 2017

(30) Foreign Application Priority Data

Sep. 7, 2015 (TW) ..... 104129505 A

(51) Int. Cl.

| | |
|---|---|
| ***H05B 33/08*** | (2006.01) |
| ***F21K 9/238*** | (2016.01) |
| ***F21V 23/00*** | (2015.01) |
| *F21Y 115/10* | (2016.01) |
| *F21V 23/02* | (2006.01) |
| *F21K 9/232* | (2016.01) |

(52) U.S. Cl.

CPC ..... *H05B 33/0815* (2013.01); *F21K 9/238* (2016.08); *F21V 23/005* (2013.01); *H05B 33/0845* (2013.01); *H05B 33/0887* (2013.01); *F21K 9/232* (2016.08); *F21V 23/02* (2013.01); *F21Y 2115/10* (2016.08)

(58) Field of Classification Search

CPC ..... H05B 33/0815; H05B 33/0845; H05B 33/0887

See application file for complete search history.

(56) References Cited

U.S. PATENT DOCUMENTS

| | | | | |
|---|---|---|---|---|
| 9,426,852 | B2 * | 8/2016 | Zudrell-Koch | H05B 41/3924 |
| 2005/0184588 | A1 * | 8/2005 | Murakami | H02M 3/33561 307/17 |

(Continued)

FOREIGN PATENT DOCUMENTS

| | | |
|---|---|---|
| TW | I437923 B | 5/2014 |
| TW | I445443 B | 7/2014 |

*Primary Examiner* — Dylan White

(74) *Attorney, Agent, or Firm* — McClure, Qualey & Rodack, LLP

(57) ABSTRACT

A light-emitting diode (LED) device including an LED module and a driver is provided. The LED module includes a voltage sensing module and an LED. The voltage sensing module generates a reference voltage. The driver includes a power converting module, a current processing module, a feedback module and a controller module. The power converting module converts an alternating current (AC) into a driving current for driving the LED to emit a light. The current processing module converts the driving current into a sensing voltage. The feedback module compares the sensing voltage with a reference voltage and outputs a level signal according to a magnitude relationship of the sensing voltage and the reference voltage. The controller module outputs a pulse width modulation (PWM) signal to the power converting module according to the level signal. The power converting module controls the magnitude of the driving current according to the PWM signal.

11 Claims, 4 Drawing Sheets

(56) References Cited

U.S. PATENT DOCUMENTS

| | | | | |
|---|---|---|---|---|
| 2007/0183156 | A1* | 8/2007 | Shan | B60Q 1/2611 362/277 |
| 2011/0215731 | A1* | 9/2011 | Jeong | H05B 33/0854 315/254 |
| 2011/0234122 | A1* | 9/2011 | Yu | G09G 3/3406 315/297 |
| 2011/0254469 | A1* | 10/2011 | Ruan | H05B 33/0809 315/307 |
| 2013/0127356 | A1* | 5/2013 | Tanaka | H05B 33/0809 315/200 R |
| 2015/0015143 | A1* | 1/2015 | Inada | H05B 33/0815 315/77 |
| 2016/0128144 | A1* | 5/2016 | Tikkanen | H05B 33/0815 315/301 |

* cited by examiner

LIGHT-EMITTING DIODE DEVICE

This application claims the benefit of Taiwan application Serial No. 104129505, filed Sep. 7, 2015, the disclosure of which is incorporated by reference herein in its entirety.

TECHNICAL FIELD

The disclosure relates in general to a light-emitting diode (LED) device, and more particularly to an LED device capable of controlling a magnitude of a driving current.

BACKGROUND

A conventional light-emitting diode (LED) module is driven by a driving circuit. Based on the magnitude of the driving current required for driving an LED module, a corresponding driving circuit is selected to work with the LED module. When many LED modules requiring different driving currents are used, different driving circuits for providing the required driving currents need to be designed, not only increasing design and manufacturing costs but also adding extra workload to warehousing management, material assignment and component assembly.

Therefore, it has become a prominent task for the industry to provide a new LED device for resolving the above problems.

SUMMARY

The disclosure is directed to a light-emitting diode (LED) device capable of reducing both the design cost and the manufacturing cast.

According to one embodiment, a light-emitting diode (LED) device including an LED module and a driver is provided. The LED module includes a voltage sensing module and an LED. The voltage sensing module is configured to generate a reference voltage. The driver includes a power converting module, a current processing module, a feedback module and a controller module. The power converting module is configured to receive and convert an alternating current (AC) into a driving current for driving the LED to emit a light. The current processing module is configured to convert the driving current into a sensing voltage. The feedback module is configured to compare the sensing voltage with a reference voltage and output a level signal according to a magnitude relationship of the sensing voltage and the reference voltage. The controller module is configured to output a pulse width modulation (PWM) signal to the power converting module according to the level signal. The power converting module is further configured to control the magnitude of the driving current according to the PWM signal.

The above and other aspects of the invention will become better understood with regard to the following detailed description of the preferred but non-limiting embodiment (s). The following description is made with reference to the accompanying drawings.

DETAILED DESCRIPTION

Figure 1:
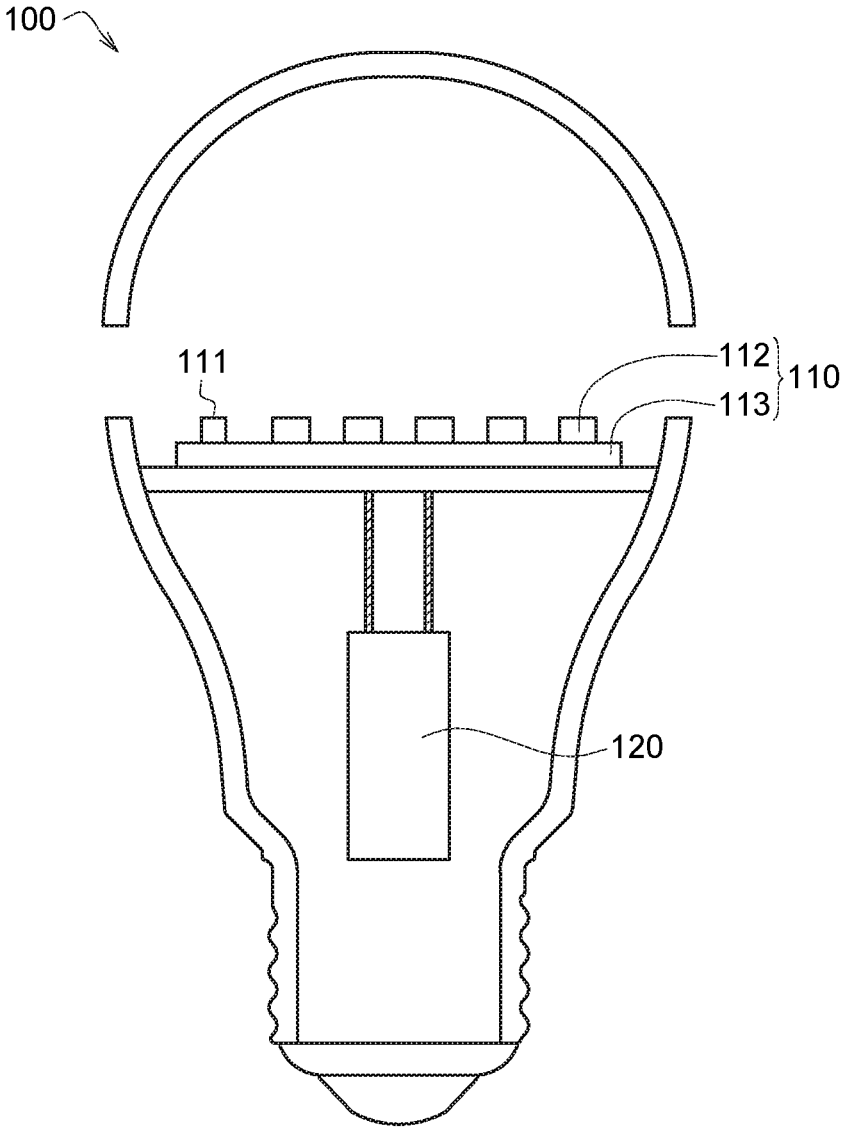
FIG. 1 is a cross-sectional view of an LED device according to an embodiment of the invention.
Figure 2:
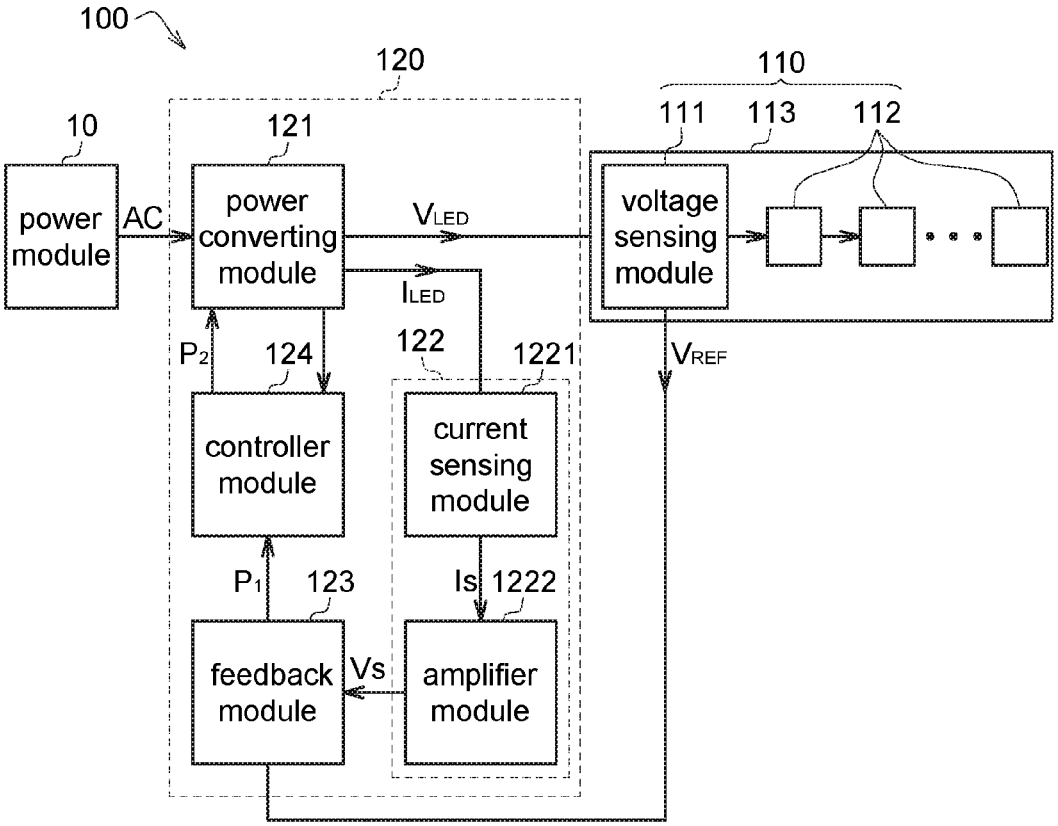
FIG. 2 is functional diagram of the LED device of FIG. 1.

Refer to FIGS. 1 and 2. FIG. 1 is a cross-sectional view of an LED device 100 according to an embodiment of the invention. FIG. 2 is functional diagram of the LED device 100 of FIG. 1.

As indicated in FIG. 1, the light-emitting diode (LED) device 100 can be realized by a bulb or an LED tube containing LED bars. The LED device 100 includes an LED module 110 and a driver 120. The LED module 110 and the driver 120 are two separate elements. That is, the LED module 110 and the driver 120 are not integrated into one element but are manufactured separately. Under such design, the driver 120 can be realized by a switch mode driver.

As indicated in FIG. 2, the LED module 110 includes a voltage sensing module 111, a plurality of LEDs 112 and a circuit board 113. The voltage sensing module 111 and the LEDs 112 are disposed on the circuit board 113 as indicated in FIG. 1. The driver 120 can be electrically connected to the circuit board 113 for controlling the voltage sensing module 111 and the LEDs 112 which are disposed on the circuit board 113.

The voltage sensing module 111 is configured to generate a reference voltage $V_{REF}$. The reference voltage $V_{REF}$ is determined according to the magnitude of the current required by the LED module 110. For example, the more the magnitude of the current required by the LED module 110 is, the higher the reference voltage $V_{REF}$ can be set to. For example, the magnitude of current is larger when the quantity of the LEDs 112 is more. Conversely, the smaller the magnitude of the current required by the LED module 110 is, the lower the reference voltage $V_{REF}$ can be set to. The driver 120 can provide the driving current $I_{LED}$ required by the LED module 110 according to the magnitude of the reference voltage $V_{REF}$. Thus, the same driver 120 can provide different currents required by the LED module 110 and there is no need to design different drivers 120 to provide different currents required by the LED module 110, not only reducing the design cost and the manufacturing cost of the LED device 100 but also reducing the workload in warehousing management, material assignment and component assembly.

The driver 120 includes a power converting module 121, a current processing module 122, a feedback module 123 and a controller module 124.

The power converting module 121 is configured to receive an alternating current AC from the power module 10 and further converting the alternating current AC into a direct current driving current $I_{LED}$. The alternating current AC is provided by such as a mains supply. The driving current $I_{LED}$ is configured to drive the LEDs 112 to emit a light. The driving current $I_{LED}$ could be higher or lower than the current required by the LED module 110.

Figure 3:
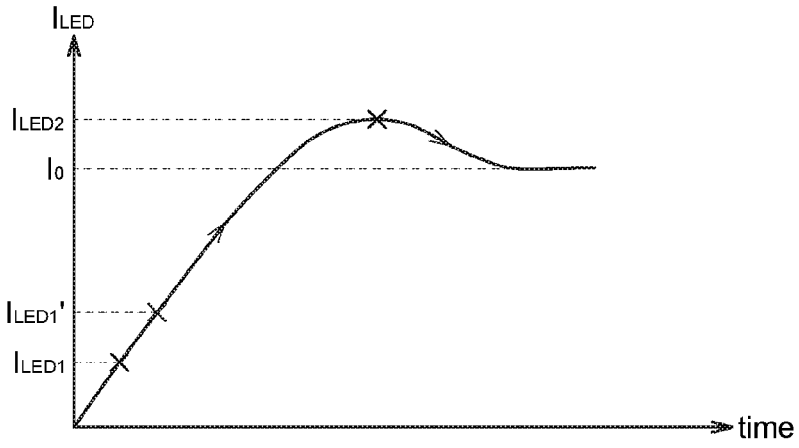
FIG. 3 is a curve diagram of driving current according to an embodiment of the invention.

As indicated in FIG. 3, a curve diagram of driving current $I_{LED}$ according to an embodiment of the invention is shown. For example, when the LED device 100 is turned on, the driving current $I_{LED}$ starts to boost from 0, but the driving current $I_{LED1}$ at the initial stage is insufficient to provide the current $I_0$ required by the LED module 110. Then, the driving current $I_{LED}$ continues to boost, and may even exceed the current $I_0$ required by the LED module 110 and reach, for example, a driving current $I_{LED2}$. If the driving current $I_{LED}$ is too small, the LED module 110 will have insufficient brightness. Conversely, if the driving current $I_{LED}$ is too large, the driving current $I_{LED}$ may damage the LED module 110. By using following methods, the driving current $I_{LED}$ can be boosted or dropped to be basically equivalent to the current $I_0$ required by the LED module 110, such that the LED module 110 can provide brightness conformed to the specification of design and at the same time the LED module 110 will not be overloaded.

For example, the current processing module 122 converts the driving current $I_{LED}$ outputted from the power converting module 121 into a sensing voltage $V_S$. Then, the feedback module 123 compares the sensing voltage $V_S$ with a reference voltage $V_{REF}$ and outputs a level signal $P_1$ according to a magnitude relationship of the sensing voltage $V_S$ and the reference voltage $V_{REF}$. Then, the controller module 124 outputs a PWM signal $P_2$ to the power converting module 121 according to the level signal $P_1$. Then, the power converting module 121 controls the magnitude of the driving current $I_{LED}$ according to PWM signal $P_2$. The above procedures can be repeated until the driving current $I_{LED}$ is basically equivalent to the current $I_0$. Detailed descriptions are disclosed below.

The current processing module 122 includes a current sensing module 1221 and an amplifier module 1222. The current sensing module 1221 converts the driving current $I_{LED}$ into a current signal $I_S$, and the amplifier module 1222 further amplifies the current signal and converts the current signal $I_S$ into a sensing voltage $V_S$.

The feedback module 123 compares the sensing voltage $V_S$ with a reference voltage $V_{REF}$ and outputs a level signal $P_1$ according to a magnitude relationship of the sensing voltage $V_S$ and the reference voltage $V_{REF}$. For example, if the reference voltage $V_{REF}$ is higher than the sensing voltage $V_S$, the level signal $P_1$ is set as one of a low-level signal and a high-level signal. In an embodiment of the invention, if the reference voltage $V_{REF}$ is higher than the sensing voltage $V_S$, then the level signal $P_1$ is at a low level; if the reference voltage $V_{REF}$ is lower than the sensing voltage $V_S$, then the level signal $P_1$ is at a high level.

Figure 4:
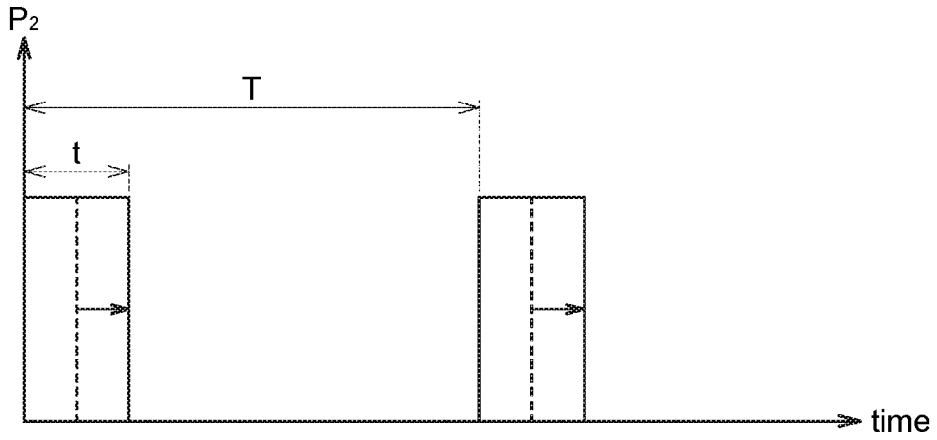
FIG. 4 is a diagram of PWM signal according to an embodiment of the invention.

Refer to FIGS. 1 and 4. FIG. 4 is a diagram of PWM signal according to an embodiment of the invention. The controller module 124 outputs a PWM signal $P_2$ to the power converting module 121 according to the level signal $P_1$. When the controller module 124 receives a level signal $P_1$ at a low level (in the present example, this indicates that the reference voltage $V_{REF}$ is higher than the sensing voltage $V_S$), this indicates that the driving current $I_{LED}$ is larger than the current $I_0$ required by the LED module 110. As indicated in FIG. 3, the driving current $I_{LED1}$ is smaller than the required current $I_0$. Therefore, in FIG. 4, the controller module 124 increases the duty cycle W1 of PWM signal $P_2$, for example, from 10% (indicated by dotted lines) to 20% (indicated by solid lines). However, in other embodiments of the invention, the duty cycle W1 is not limited to the said exemplification. For example, the duty cycle W1 can be defined as t/T, that is, a ratio of the turn-on time t to the period T.

Then, the power converting module 121 controls the magnitude of the driving current $I_{LED}$ according to the PWM signal $P_2$. For example, when the duty cycle W1 of FIG. 4 is increased, the power converting module 121 increases the driving current $I_{LED}$ provided to the LED module 110, and the driving current $I_{LED}$ is boosted to $I_{LED1}$ from $I_{LED1}$ as indicated in FIG. 3.

Then, based on the above principles, the driver 120 continues to judge the magnitude of the sensing voltage $V_S$ and the reference voltage $V_{REF}$, converts the sensing voltage $V_S$ into a corresponding driving current $I_{LED}$ and further provides the corresponding driving current $I_{LED}$ to the LED module 110, such that the driving current $I_{LED}$ gets closer and closer to the driving current $I_0$.

Figure 5:
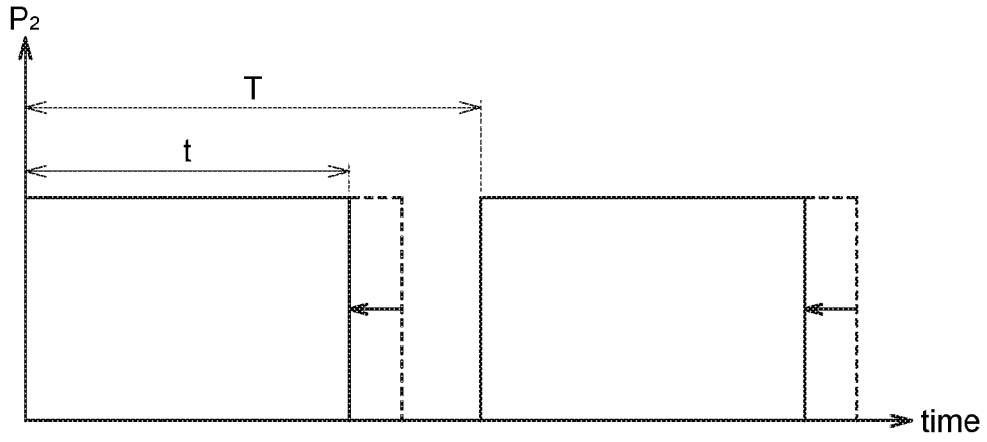
FIG. 5 is a diagram of PWM signal according to another embodiment of the invention.

Refer to FIGS. 1 and 5. FIG. 5 is a diagram of PWM signal according to another embodiment of the invention is shown. When the controller module 124 receives a level signal $P_1$ at a high-level (in the present example, this indicates that the reference voltage $V_{REF}$ is lower than the sensing voltage $V_S$), this indicates that the driving current $I_{LED}$ is larger than the current $I_0$ required by the LED module 110. As indicated in FIG. 3, the driving current $I_{LED2}$ is larger than the required current $I_0$. Therefore, in FIG. 5, the controller module 124 decreases the duty cycle W1 of the PWM signal $P_2$, from example, from 70% (indicated by dotted lines) to 60% (indicated by solid lines). However, in other embodiments of the invention, the duty cycle W1 is not limited to the said exemplification.

Then, the power converting module 121 controls the magnitude of the driving current $I_{LED}$ according to the PWM signal $P_2$. For example, since the duty cycle W1 of FIG. 5 is decreased, the power converting module 121 decreases the driving current $I_{LED}$ provided to the LED module 110, and the driving current $I_{LED}$ drops to the required current $I_0$ from the driving current $I_{LED2}$ as indicated in FIG. 3.

Then, based on the above principles, the driver 120 continues to judge the magnitude of the sensing voltage $V_S$ and the reference voltage $V_{REF}$, converts the sensing voltage $V_S$ into a corresponding driving current $I_{LED}$ and further provides the corresponding driving current $I_{LED}$ to the LED module 110, such that the driving current $I_{LED}$ is within the permissible range of the current $I_0$ required by the LED module 110.

It can be known from the above disclosure that the duty cycle W1 of the PWM signal $P_2$ is proportional to the sensing voltage $V_S$, and the driving current $I_{LED}$ is proportional to duty cycle W1.

Figure 6:
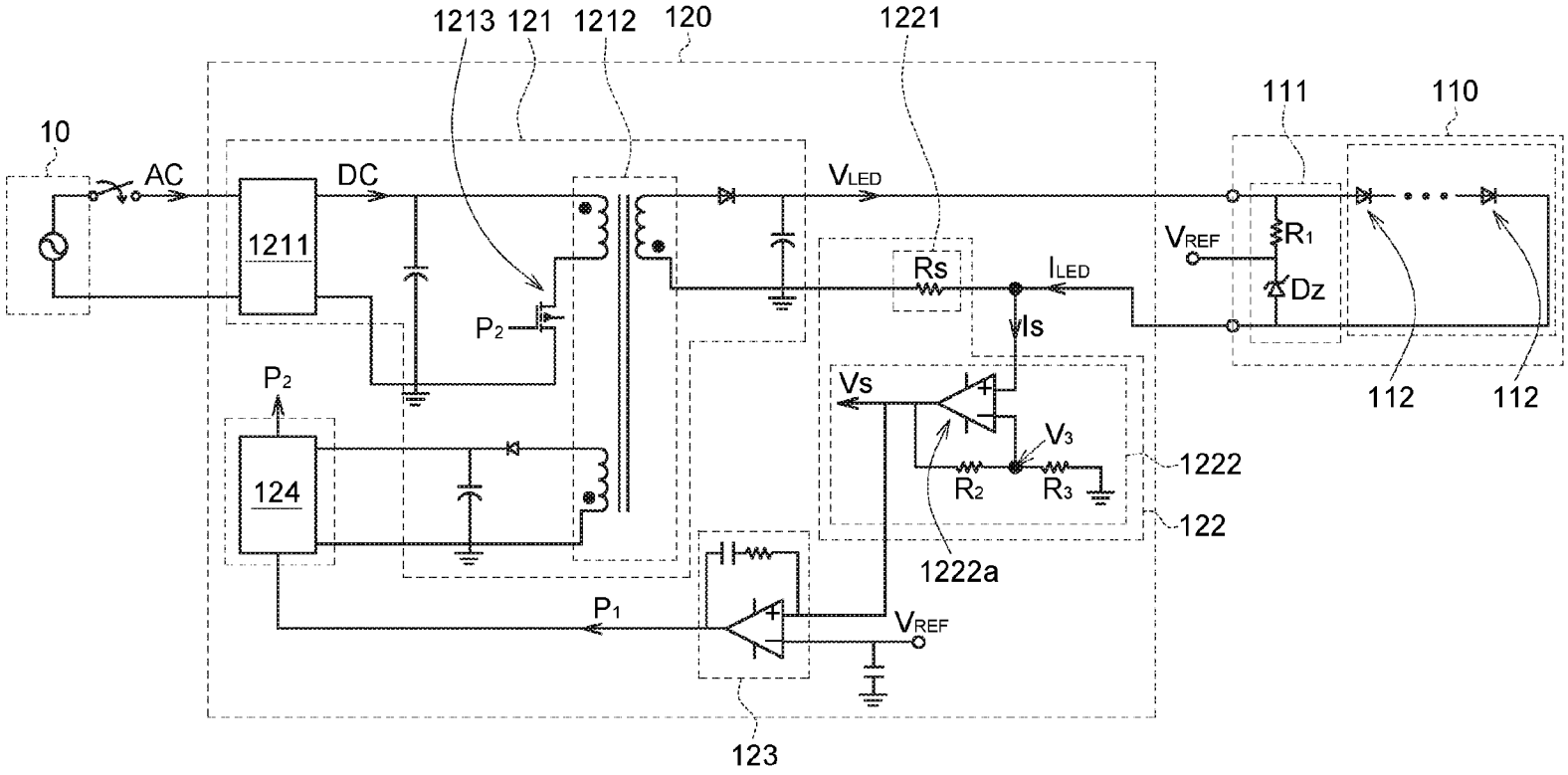
FIG. 6 is a circuit diagram of the LED module and the driver of FIG. 1.

FIG. 6 is a circuit diagram of the LED module 110 and the driver 120 of FIG. 1. The voltage sensing module 111 includes a diode $D_Z$, such as a Zener diode. The reference voltage $V_{REF}$ is determined according to the reverse voltage of the diode $D_Z$. For example, when the diode $D_Z$ has a reverse voltage of 17 volts (V), the reference voltage $V_{REF}$ is also about 17 V. Thus, the reference voltage $V_{REF}$ with different design values can be obtained by selecting the diode $D_Z$ with different reverse voltages.

The power converting module 121 includes a rectifier 1211, a transformer 1212 and a switch 1213. The rectifier 1211 converts an alternating current AC into a direct current DC. The transformer 1212 changes, for example, drops or boosts the voltage of the direct current DC to a driving voltage $V_{LED}$. The switch 1213 controls the transformer 1212 to be turned on/off according to the PWM signal $P_2$. For example, when the PWM signal $P_2$ is in an ON state, the switch 1213 controls the transformer 1212 to be turned on; when the PWM signal $P_2$ is in an OFF state, the switch 1213 controls the transformer 1212 to be turned off.

The current sensing module 1221 can be realized by such as a resistor $R_S$. The current signal $I_S$ is a diverted current of the driving current $I_{LED}$, and the value of the current signal $I_S$ is determined according to the value of the resistor $R_S$. That is, a corresponding current signal $I_S$ can be obtained through the design of the resistor $R_S$.

The amplifier module 1222 can be composed of an amplifier 1222*a* and two series-connected resistors $R_2$ and $R_3$. When the current signal $I_S$ flows through the resistor $R_3$, a corresponding voltage difference $V_3$ will be generated.

The feedback module 123 can be realized by such as a comparer, which compares the magnitude of the sensing voltage $V_S$ with that of the reference voltage $V_{REF}$ and accordingly outputs a level signal $P_1$.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A light-emitting diode (LED) device, comprising:

an LED module, comprising:

a voltage sensing module configured to generate a reference voltage; and an LED;

a driver, comprising:

a power converting module configured to receive and convert an alternating current (AC) into a driving current for driving the LED to emit light;

a current processing module configured to convert the driving current into a sensing voltage;

a feedback module configured to compare the sensing voltage with a reference voltage and output a level signal according to a magnitude relationship of the sensing voltage and the reference voltage; and a controller module configured to output a pulse width modulation (PWM) signal to the power converting module according to the level signal;

wherein the power converting module is further configured to control a magnitude of the driving current according to the PWM signal; and wherein the driver and the LED module are disposed separately, the LED module comprises a circuit board on which the voltage sensing module and the LED are disposed, and the driver is disposed outside the circuit board.

2. The LED device according to claim 1, wherein a duty cycle of the PWM signal is proportional to the sensing voltage.

3. The LED device according to claim 1, wherein the driving current is proportional to a duty cycle of the PWM signal.

4. The LED device according to claim 1, wherein the controller module is further configured to:

increase a duty cycle of the PWM signal if the reference voltage is higher than the sensing voltage.

5. The LED device according to claim 1, wherein the controller module is further configured to:

decrease a duty cycle of the PWM signal if the reference voltage is lower than the sensing voltage.

6. The LED device according to claim 1, wherein the feedback module is further configured to:

set a level signal as one of a low-level signal and a high-level signal if the reference voltage is higher than the sensing voltage; and set the level signal as the other one of the low-level signal and the high-level signal if the reference voltage is lower than the sensing voltage.

7. The LED device according to claim 1, wherein the current processing module comprises:

a current sensing module configured to convert the driving current into a current signal; and an amplifier module configured to amplify the current signal and convert the current signal into the sensing voltage.

8. The LED device according to claim 1, wherein the driver is a switch mode driver.

9. The LED device according to claim 1, wherein the voltage sensing module comprises a diode, and the reference voltage is determined according to a reverse voltage of the diode.

10. The LED device according to claim 9, wherein the diode is a Zener diode.

11. The LED device according to claim 1, wherein the current sensing module is a resistor.

* * * * *